United States Patent [19]

Simard et al.

[11] Patent Number: 4,806,925

[45] Date of Patent: Feb. 21, 1989

[54] INFRARED SIGNALING SYSTEM FOR DETECTING A PREDETERMINED STATE OF A HIGH VOLTAGE DEVICE

[75] Inventors: Julien Simard, Brossard; Raymond Lessard, Charny; Yves Bélanger, Montmagny, all of Canada

[73] Assignee: Hydro-Quebec, Montreal, Canada

[21] Appl. No.: 42,441

[22] Filed: Apr. 24, 1987

[51] Int. Cl.[4] ..... G08B 5/14

[52] U.S. Cl. ..... 340/815.25; 340/556; 340/644; 340/870.28; 356/375

[58] Field of Search ..... 340/815.25, 556, 644, 340/687, 870.28; 356/372, 375; 335/17; 200/DIG. 47

[56] References Cited

U.S. PATENT DOCUMENTS

| | | | |
|---|---|---|---|
| 3,659,949 | 5/1972 | Walsh | 356/372 |
| 3,852,556 | 12/1974 | Kane et al. | 340/815.25 |
| 4,236,149 | 11/1980 | Soyck | 340/644 |
| 4,250,498 | 2/1981 | Walter | 340/556 |
| 4,451,910 | 5/1984 | Simard | 340/644 |
| 4,546,246 | 10/1985 | Bechtel | 340/556 |

*Primary Examiner*—John W. Caldwell, Sr.
*Assistant Examiner*—Tyrone Queen
*Attorney, Agent, or Firm*—Oblon, Fisher, Spivak, McClelland & Maier

[57] ABSTRACT

A semaphore for use in a detection system for a high voltage device and for signalling a predetermined state of the device. The semaphore comprises a housing supporting therein a retroreflector element. The housing has an aperture and the retroreflector has a reflective surface supported in a alignment with the aperture. The housing is mounted in close proximity to the device. A linkage is associated with the housing and the device and is actuated upon the occurrence of a predetermined condition whereby to expose the reflective surface in the housing for the reflection of signals through the apertures. A remote scanning device continuously generates infrared signals in the direction of the aperture and detects reflective signals from the reflective surface.

10 Claims, 2 Drawing Sheets

INFRARED SIGNALING SYSTEM FOR DETECTING A PREDETERMINED STATE OF A HIGH VOLTAGE DEVICE

BACKGROUND OF THE INVENTION

1. Field of the Invention

The present invention relates to a semaphore for use in a detection system and a method of detecting a predetermined state in a high voltage (HV) device, and wherein the predetermined state of the device, when sensed, activates a retroreflective device to reflect infrared signals continuously generated at the device and wherein the reflected signals are indicative that the HV device has reached a predetermined state.

2. Description of Prior Art

In our U.S. Pat. No. 4,451,910 there is described a signalling system which is associated with a high voltage device, herein a disconnect switch, whereby to signal the relative position of a moving contact in relation to a fixed contact. The system as disclosed therein is an ultrasonic system and which has proven extremely expensive to construct, and which may not be efficient during severe weather conditions, such as during a snowstorm, where the reflective surface of the mirrors in the receiver device may be obstructed by snow and ice, and render the receiver inaccurate.

The infrared detecting system of the present invention was conceived for use with a high voltage switch of the type disclosed in the referenced patent and having a fixed contact and a movable contact, and as utilized in an electrical distribution and transport network. However, the detecting system may have other applications with other high voltage devices such as for the monitoring of gas pressure in a high voltage device, or monitoring the level of oil in high voltage devices.

As described in our earlier U.S. Pat. No. 4,451,910, up to now the positions of the contact elements of high voltage disconnect switches have been ascertained by sensing the mechanism which displaces the moving contact blade which is used to close or open the switch. Microswitches are associated with the motorized mechanical connections of the moving contacts to generate signals identifying the position of the moving contact. However, such interconnecting drive mechanisms between the drive motor and the moving contact blade have many flexible connections and are sometimes inaccurate in the operation, and therefore could cause an inaccurate closure of the moving contact, although the microswitches would indicate that the contact is properly closed. Such errors could cause the destruction of the contacts when a strong current passes through the disconnect switch, and in certain cases it is necessary to make visual inspection of the disconnect switch to ascertain the position of its contacts. Therefore, presently known signalling systems are not totally reliable as to the information which they provide and prevent their use in a remote controlled system as often a visual inspection of the disconnect switch would be required.

SUMMARY OF INVENTION

It is a feature of the present invention to provide a detection system using a semaphore to signal a predetermined state of a high voltage device by reflecting infrared signals continuously generated in the direction of the retroreflector in the semaphore, and wherein the signals are reflected back by a retroreflector which is pivotally mounted in the semaphore housing.

Another feature of the present invention is to provide a method of detecting a predetermined state in a high voltage device by the use of an infrared detection system consisting of a semaphore having a retroreflector element therein which is pivotally mounted to reflect infrared signals continuously generated in the direction of the retroreflector in the semaphore upon the detection of a predetermined state of the high voltage device.

According to the above features, from a board aspect, the present invention provides a semaphore for use in a detection system for a high-voltage (HV) device, and for signalling a predetermined state of the device. The semaphore comprises a housing supporting therein a retroreflector element. The housing has an aperture and the retroreflector has a reflective surface which is supported in alignment with the aperture. Means is provided for mounting the housing in close proximity to the device. A linkage is associated with the housing and the device and is actuated upon the occurrence of the predetermined condition whereby to expose the reflective surface in the housing for reflecting of signals through the aperture. A remote scanning device continuously generates infrared signals in the direction of the retroreflector, and also detects reflected signals from the reflective surface of the retroreflector.

According to a still further broad aspect of the present invention there is provided a method of detecting a predetermined state in a high voltage (HV) device. The method comprises the steps of supporting a retroreflective device in a housing having an aperture in alignment with the retroreflective device. The retroreflective device has a reflective surface and is pivotable to a reflecting and a nonreflecting position. A predetermined state of the high voltage device is sensed through a linkage means which is connected for pivotal displacement of the retroreflective device. Infrared signals are transmitted in the direction of the retroreflector, and a detector detects infrared signals which are reflected back by the reflective surface of the retroreflector when positioned to its reflecting position by the linkage upon the occurrence of the predetermined state of the HV device.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
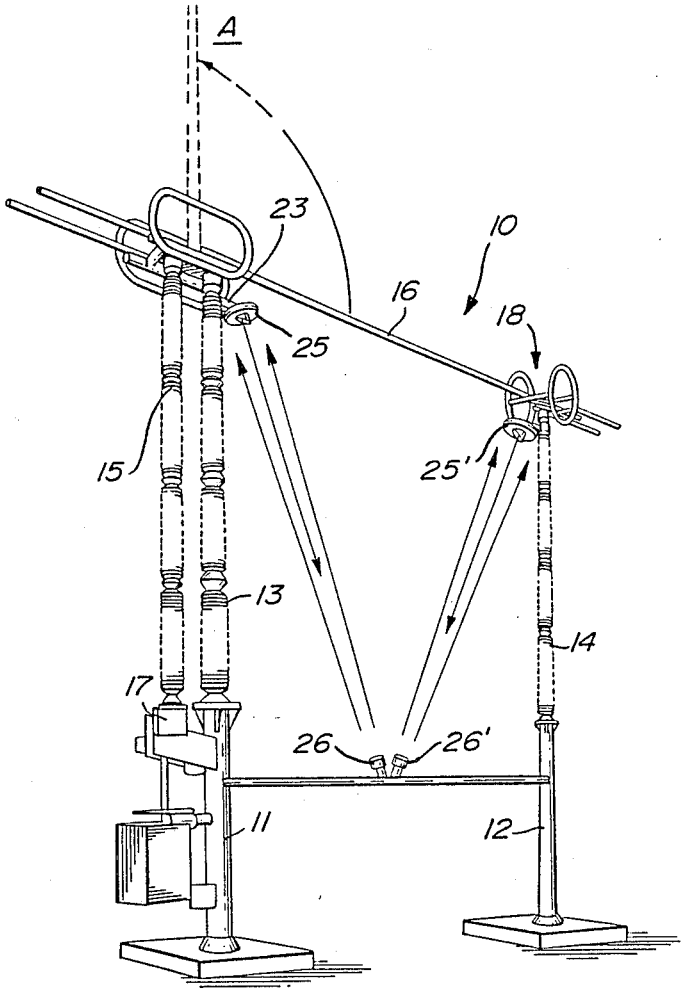
FIG. 1 is a perspective view illustrating schematically the mounting of a disconnect switch utilizing the signalling system of the present invention.

Referring now to the drawings, and more particularly to FIG. 1, there is shown generally at 10 a high voltage disconnect switch which is usually connected to a transmission line of a three-phase electrical transmission system (not shown). The disconnect switch comprises essentially two metal support structures 11 and 12, each having a column of porcelain insulators 13 and 14, respectively. A further insulating column 15 of insulators is associated with the displaceable contact arm 16 of the disconnect switch and is rotatable by a drive motor 17 whereby to cause the blade contact 16 to axially rotate. Such a structure is well known in the art.

Figure 2:
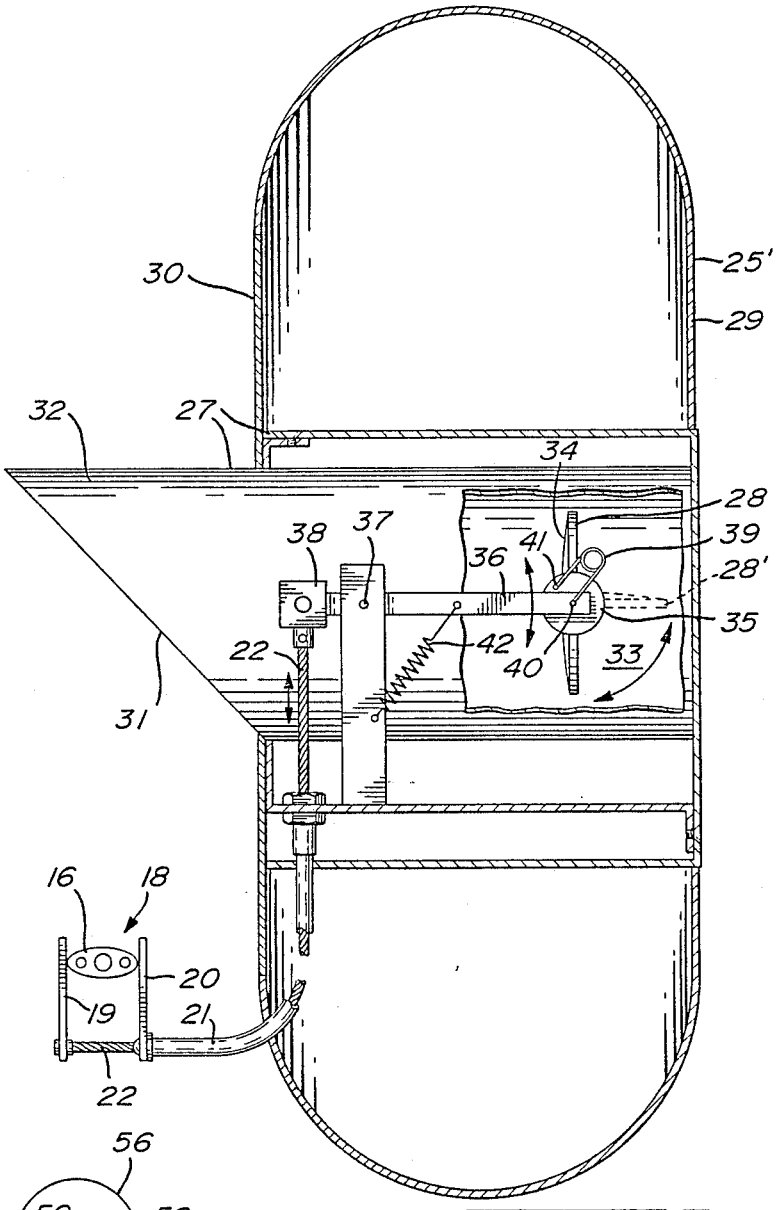
FIG. 2 is a section view illustrating the construction of the semaphore.

Referring additionally to FIG. 2, there is schematically illustrated the construction of the fixed contact 18 which receives the blade contact 16 to complete the circuit. The fixed contact comprises sets of opposed contact fingers such as 19 and 20 with contact finger 19 being spring-biased towards fixed contact 20. When the blade 16 enters between the two contact fingers 19 and 20, it is axially rotated by the drive 17 to assume the position as illustrated in FIG. 2, with the contact jaw being open and pressure being applied on the blade by the contact fingers 19 and 20. This assures good electrical conduction through the stationary contact. As previously described in our above-referenced U.S. patent, a cable 21 has a displaceable inner wire 22 connected to the movable contact finger 19 to transmit a mechanical signal of the position of the movable finger when fully engaged by the blade, as shown in FIG. 2. It is also implied that in some applications, inner wire 22 would be displaced by specially shaped "dummy" fingers installed in the proximity of the normal fingers.

When the movable contact blade is fully retracted, it assumes a position as shown in phantom lines at A.

As shown in FIG. 1, the detection and signalling system of the present invention consists in the provision of a semaphore 25 and 25' associated respectively with the movable contact 16 and the stationary contact 18. A pair of infrared scanning devices 26 are each associated with their respective semaphores 25 and 25', and generate and detect a narrow beam of infrared signals at their respective semaphores and specifically at the aperture 33 thereof. These scanners 26 are well known in the art such as provided by Banner, Model SBLX-1, which is a special purpose retroreflective scanner for long range applications.

Figure 3:
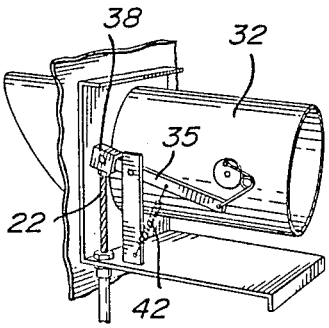
FIG. 3 is a further perspective view illustrating a subassembly of the semaphore housing.

Referring now more specifically to FIGS. 2 and 3 there will be described the construction of the semaphore device 25' associated with the fixed contact 18. It is pointed out that the other device 25 is of identical construction, but its cable 23 is operated by a linkage (not shown), which is actuated when the contact arm 16 reaches a fully open position A. The semaphore consists of a housing subassembly 27, housing a retroreflector element 28. A further housing subassembly 29 is provided with a rounded shape wall to prevent corona discharge from environmental high voltage circuits, and to prevent direct sunrays from saturating the receiver of the associated scanning device 26. The forward face 30 of the housing 29 is preferably of a nonreflecting finish. A tube 31 also forms part of the subassembly 27 and constitutes a housing for the retroreflector 28. The tube also forms the aperture 33 which receives the infrared signals and reflects them when the retroreflector 28 is in a reflective position, as shown in FIG. 2. A visor 32 is formed by an extension of the tube 31 protruding forwardly of the front face 30 to prevent accumulation of wind driven snow on the reflector.

As herein shown, the retroreflector is a corner-cube type reflector having a reflective surface 34 and mounted on a pivotal connection to which is secured a disc 35 located outside the cone 32 (see FIG. 3). The retroreflector disc 28 is displaceable to a nonreflective position, as shown in phantom as indicated by reference numeral 28', to a reflective position as shown in FIG. 2. This displacement is effected by a toggle linkage which comprises a pivotally mounted arm 36 having an intermediate pivot 37. The cable 22 from the movable contact finger 19 is secured at one end of the pivoted arm 36 through a suitable attachment part 38. The other end of the arm has a flexible connecting element constituted by a linkage spring 39, with the spring having an end 40 connected to the arm 36 and the other end 41 connected to the disc 35. The pivoted arm 36 is normally spring-biased in a downward direction, where the disc assumes its nonreflecting position as shown at 28', by a tension spring 42.

As can be seen in FIGS. 2 and 3, when the contact finger 19 is displaced outwardly to its position as shown in FIG. 2, the wire 22 will pull down on the connected end of the arm 36 causing the spring attachment end of the arm 36 to move upwardly. This applies tension in the linkage spring 39 and quickly rotates the disc 35 to its position as shown in FIG. 2, that is to say, the retroreflector snaps into its reflective position. Accordingly, infrared rays entering the tube through the aperture 33 and aligned on the mirror will be reflected back at the associated scanner 26', which detects the reflected rays indicating that the contact blade 16 has entered the jaw of the stationary contact 18, and has opened the jaws to assume a proper operation of the HV switch. In the specific application the infrared signals generated by the scanner were pulsated infrared signals, and they provide the advantage of preventing the scanner to be affected by ambient infrared rays that may come from the sun indirectly or from any other light source such as electric arcs.

Figure 4:
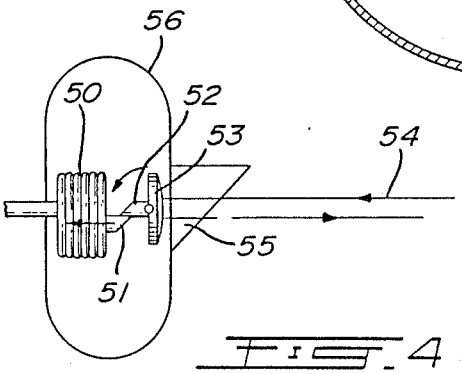
FIG. 4 is a schematic illustration of a semaphore utilized in accordance with the present invention, but for detecting pressure change in a high voltage pressure switch.

Referring now to FIG. 4, there is shown another application of the semaphore of the present invention, and in this particular instance, for detection of the pressure level of a gas in a high voltage circuit breaker or a level of insulating oil in a transformer or bushing or any other variable that may be interesting to be monitored. As herein shown, the linkage would include a pressure gauge type device 50 having a connection 51 which disengages with a connection 52 associated with the retroreflector 53. If the pressure in the guage 50 falls or increases above predetermined limits, the connections 51 and 52 would disengage and cause the retroreflector 53 to assume a horizontal position by suitable spring-biasing means, not shown, to prevent reflecting the infrared rays 54 directed in the aperture 55 of the housing 56.

Many other applications of the detecting device of the present invention are conceivable and particularly for use with high voltage devices, i.e., where the voltage is in the range of 735 kV. Summarizing, the present invention provides a method and a system for detecting a predetermined state in a high voltage (HV) device by supporting a retroreflective device in a housing. The has an aperture in alignment with the retroreflector. The retroreflective device has a reflective surface which is pivotally mounted for displacement to a reflecting and a nonreflecting position. A predetermined state of the HV device is sensed by a linkage which is connected for pivotal displacement of the retroreflective device whereby, upon detection of the predetermined state, the reflective surface is positioned to reflect back infrared signals which are continuously transmitted at the aperture and retroreflector by a scanner device located remotely of the semaphore.

It is within the ambit of the present invention to cover any obvious modifications of the examples of the preferred embodiment described herein, provided such modifications fall within the scope of the appended claims.

We claim:

1. A semaphore for use in a detection system for a high voltage (HV) device and for signaling a predetermined state of said device, said semaphore comprising a housing supporting therein a retroreflector element, said housing having an aperture, said retroreflector having a reflective surface supported in alignment with said aperture, said retroreflector being pivotally mounted in said housing and actuable by a toggle linkage for displacing said reflective surface from a first nonreflective position to a second reflective position, means for mounting said housing in close proximity to said device, said toggle linkage being connected to a cable which is actuated upon the displacement of a movable switch contact upon the occurence of said predetermined condition whereby to expose said reflective surface in said housing for reflection of light signals through said aperture, and a remote scanning device continuously generating infrared signals in the direction of said aperture and detecting reflective infrared signals from said reflective surface when positioned in a reflective position.

2. A semaphore as claimed in claim 1 wherein said device is an HV disconnect switch having at least one said movable switch contact and at least one fixed contact, said retroreflector being pivotally mounted in said housing and actuable by a toggle linkage for displacing said reflective surface from a first non-reflective position to a second reflective position, there being two of said semaphores associated with a respective one of said movable contact and fixed contact, said reflective surface being displaced to said reflective position when the associated contact is in said predetermined state, there being a scanning device associated with a respective one of said two semaphores.

3. A semaphore as claimed in claim 1 wherein said reflective surface is displaceable from a horizontal position extending axially with a central axis passing through said aperture, and to a vertical position being at substantially right angles to said central axis, said retroreflector being secured to a pivot connection.

4. A semaphore as claimed in claim 3 wherein said toggle linkage comprises pivotally mounted arm having an intermediate pivot secured to said arm, said cable being secured to one end of said arm, the other end of said arm having a flexible connecting element which is secured to said pivot connection of said retroreflector to displace said reflective surface to said first or second position depending on the position of said other end of said arm.

5. A semaphore as claimed in claim 4 wherein said flexible connecting element is a linkage spring linking said other end of said arm to a connector secured to said pivot connection of said retroreflector.

6. A semaphore as claimed in claim 5 wherein said arm is spring-biased in a direction where said reflective surface is in a nonreflective position, said cable when actuated overcoming the spring-biased force of said arm.

7. A semaphore as claimed in claim 4 wherein said housing has a rounded protective portion to prevent corona discharge from environmental HV circuits and to prevent direct sunrays from reaching in the direction of said remote scanning device.

8. A semaphore as claimed in claim 4 wherein said fixed contact of said disconnect switch has at least one flexible contact or "dummy" finger capable of being displaced by a pressure exerted thereon by said movable contact, and wherein the said cable of said semaphore associated with said fixed contact is connected to said flexible contact finger so that the movement of said finger will be transferred to said pivotally mounted arm through said cable to displace said reflective surface to one of its two positions.

9. A semaphore as claimed in claim 8 wherein the other of said semaphores has its said cable connected to said movable contact to detect a fully drawn position of said movable contact.

10. A semaphore as claimed in claim 1 wherein said device is a pressurized gas HV circuit breaker or oil filled device, said linkage being a pressure sensitive linkage operated by a change in the internal pressure of said device, said retroreflector being pivotally mounted in said housing for displacing said reflective surface from a first nonreflective position to a second reflective position upon detection of a predetermined change in the internal pressure of said HV switch.

* * * * *